United States Patent [19]

Coday

[11] 4,211,043

[45] Jul. 8, 1980

[54] PRECAST CONCRETE BUILDING MODULE FORM

[76] Inventor: Jerry F. Coday, 3580 Eola Dr., N.W., Salem, Oreg. 97304

[21] Appl. No.: 867,452

[22] Filed: Jan. 6, 1978

[51] Int. Cl.[2] ..... E04B 1/342; E04H 1/00

[52] U.S. Cl. ..... 52/79.1; 52/220; 52/234; 52/372; 52/602

[58] Field of Search ..... 52/602, 79.7, 79.13, 52/79.14, 79.1, 73, 91, 610, 79.11, 79.12, 438, 134, 136, 236.3, 234, 220, 372

[56] References Cited

U.S. PATENT DOCUMENTS

| | | | |
|---|---|---|---|
| 868,411 | 10/1907 | Cilek | 52/602 |
| 1,367,289 | 2/1921 | Waller | 52/91 |
| 1,451,000 | 4/1923 | White | 52/602 |
| 1,506,822 | 9/1924 | Foster | 52/73 |
| 1,924,801 | 8/1933 | Olmsted | 52/438 |
| 2,202,745 | 5/1940 | Muse | 52/438 |
| 2,497,887 | 2/1950 | Hilpert | 52/602 |
| 3,287,865 | 11/1966 | Lockman | 52/136 |
| 3,468,081 | 9/1969 | Saarinen | 52/79.13 |
| 3,484,999 | 12/1969 | Van Der Lely | 52/79.7 |
| 3,528,209 | 9/1970 | Schillinger | 52/223 |
| 3,646,814 | 2/1972 | Martin | 52/79.13 |
| 3,744,200 | 6/1969 | Rice | 52/227 |
| 3,878,656 | 5/1975 | Duwe et al. | 52/134 |
| 3,894,373 | 7/1975 | Willingham | 52/236 |
| 4,048,772 | 9/1977 | Gaul | 52/610 |

FOREIGN PATENT DOCUMENTS

| | | | |
|---|---|---|---|
| 865652 | 2/1953 | Fed. Rep. of Germany | 52/79.14 |
| 2438886 | 4/1976 | Fed. Rep. of Germany | 52/79.14 |
| 1194372 | 6/1970 | United Kingdom | 52/79.1 |

*Primary Examiner*—James L. Ridgill, Jr.

*Attorney, Agent, or Firm*—Klarquist, Sparkman, Campbell, Leigh, Hall & Whinston

[57] ABSTRACT

A precast monolithic concrete building module includes a vertical wall, a horizontal roof and a pair of roof supporting legs spaced from the wall. A plurality of ribs project outwardly from the wall and also from the lower surface of the roof. In one embodiment, generally T-shaped metal studs each have a portion cast into an associated rib and a portion providing a mounting surface for wall and ceiling covering materials. The studs project outwardly from the ribs so that wiring passageways can be placed through them without having to drill through concrete. In other embodiments, wooden studs have attached fasteners which have a portion cast into the rib to secure the stud to the rib. The wall between the studs is thin so that window and door openings can easily be made by breaking out portions of the wall. Special sealing ridges project upwardly from the roof for use in sealing pairs of adjacent modules of a building. The form for casting the module includes roof, wall and leg forming portions. Both the roof and wall forms have rib defining cups which receive the studs prior to casting. The rear wall of the wall form is mounted on a rolling platform for movement away from the module after casting is complete. Also, the front of the wall form is pivoted to the roof for swinging away from the module when the form is stripped.

7 Claims, 15 Drawing Figures

FIG. 1
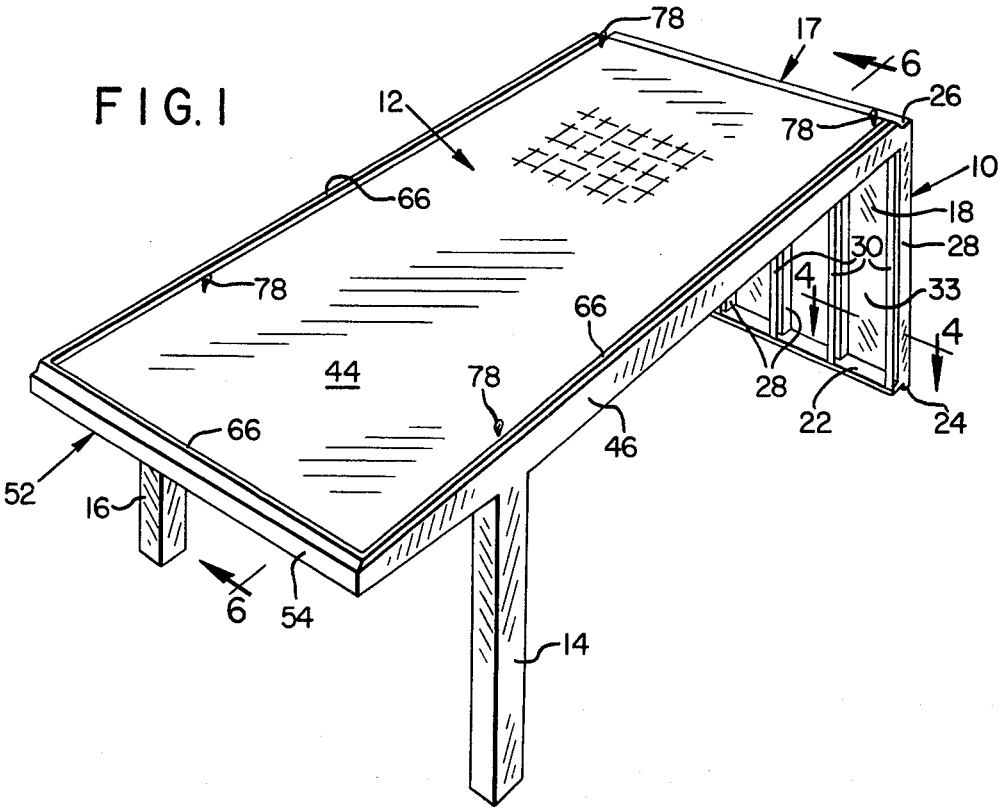
FIG. 2
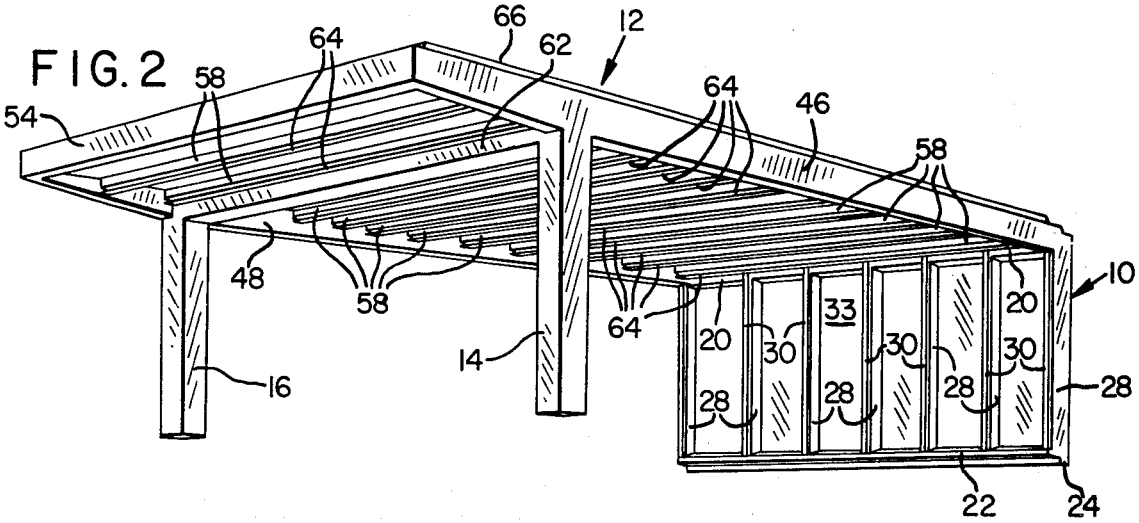
FIG. 3
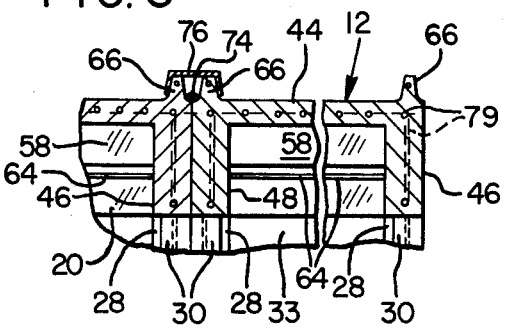
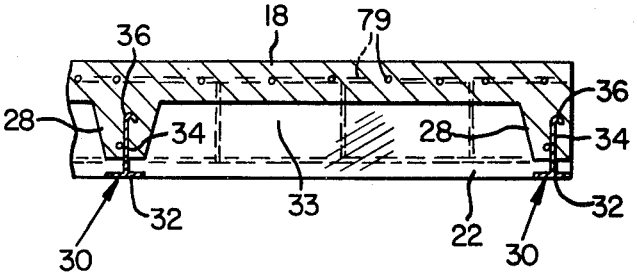
FIG. 4

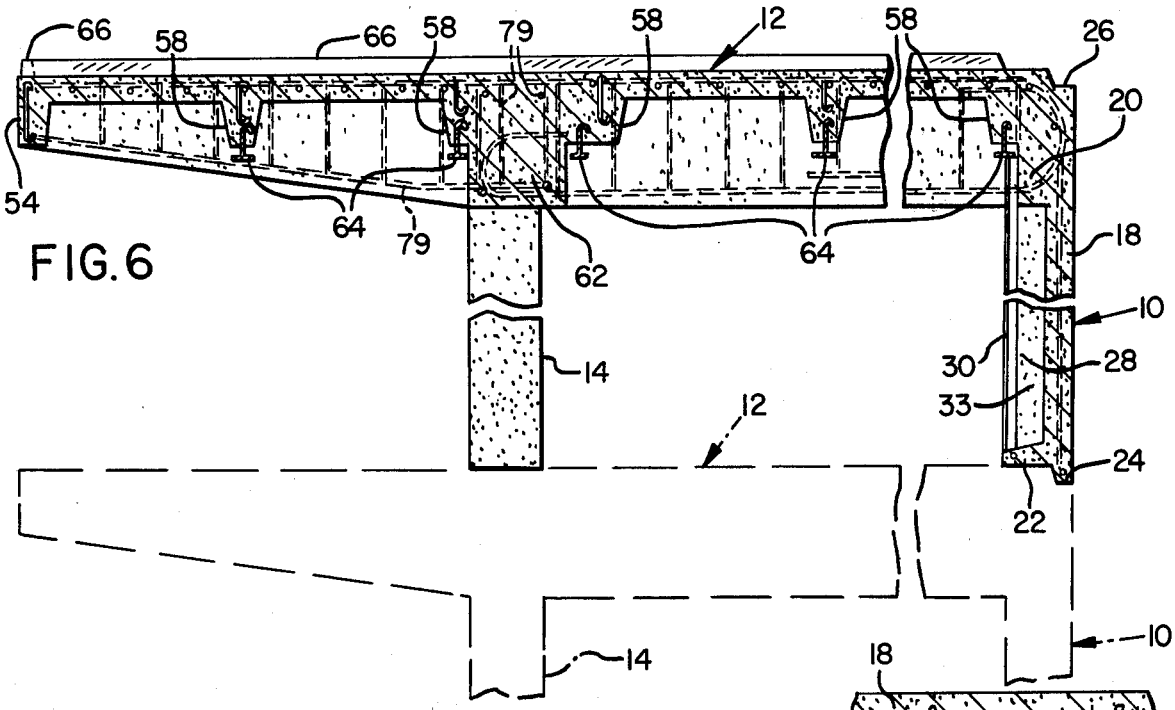
FIG. 6
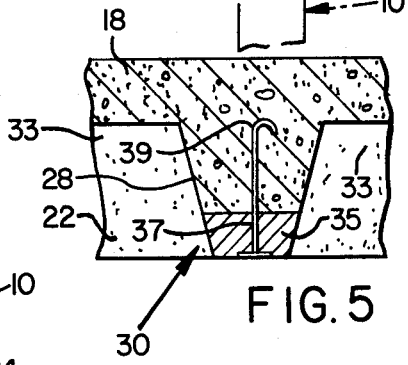
FIG. 5
FIG. 7
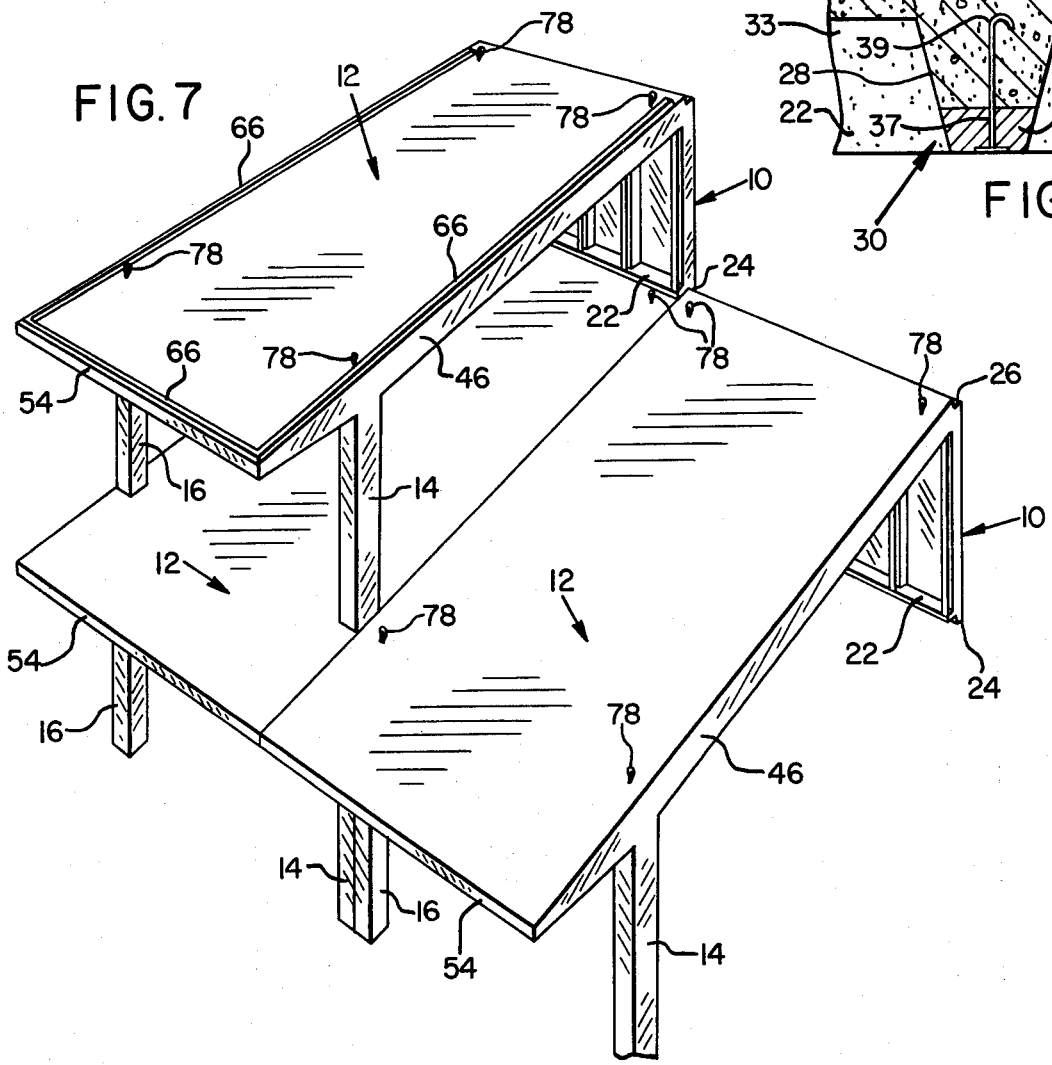

FIG. 15
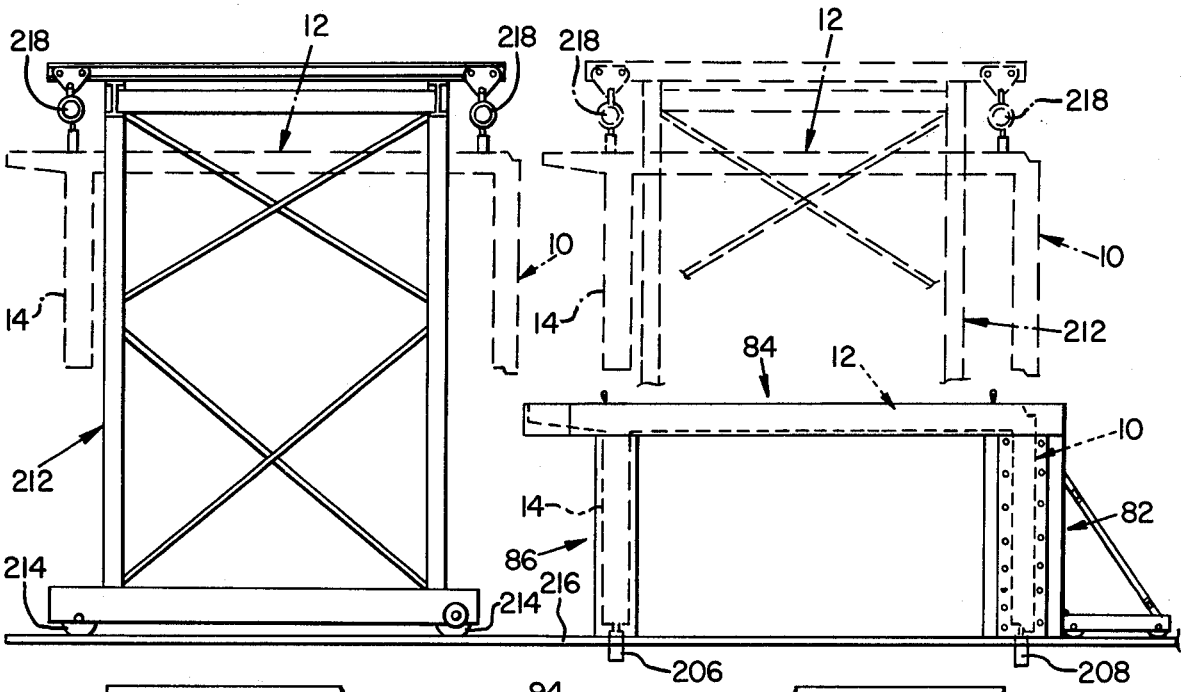
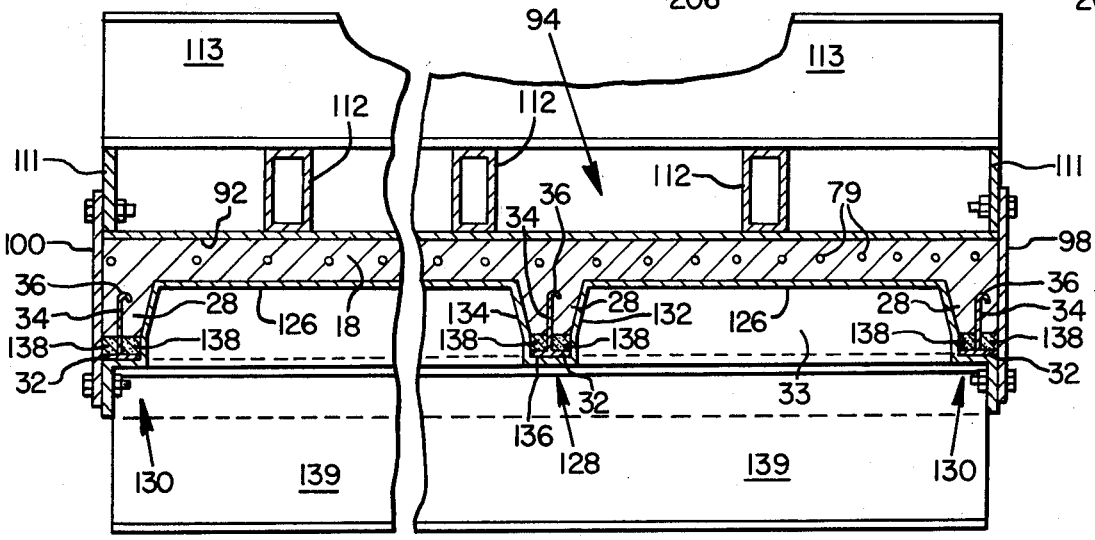
FIG. 9
FIG. 10
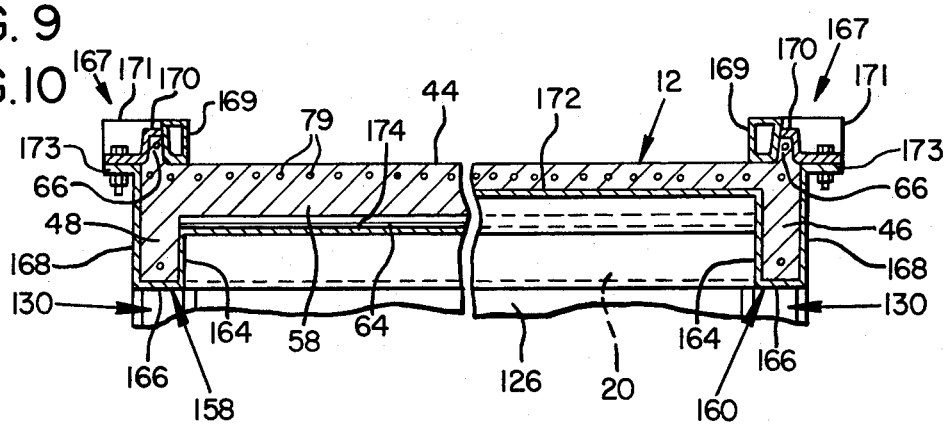

PRECAST CONCRETE BUILDING MODULE FORM

BACKGROUND OF THE INVENTION

1. Field of the Invention

The present invention relates to a precast monolithic concrete building module and a form for casting the same. More particularly, the invention relates to such a module having a wall with a plurality of ribs and stud members secured to the ribs by fastener portions cast into the ribs.

2. Description of Prior Art

Typically, forms for a concrete building wall are erected at a job site and concrete is poured into them. After the concrete cures and the forms have been stripped, wooden nailing strips are secured to the wall for use in attaching wall covering materials. However, not only is it time consuming to construct the forms and wait for the concrete to cure during construction of the building, it is difficult to drive fasteners into the concrete wall for mounting the nailing strips.

In U.S. Pat. No. 3,528,209 of Schillinger, a nailing strip is cast flush with one surface of a concrete post. However, forms still must be constructed for casting a wall to which these posts are subsequently secured.

A common drawback of concrete buildings is the extensive preplanning of wiring and plumbing that is required. That is, such buildings usually require the placement of conduit in their walls through which wiring may be pulled. As a result, it is expensive to modify the wiring of such buildings because holes usually must be bored through concrete to accomodate the changed wiring. Another problem common in concrete buildings is the difficulty of insulating these structures.

Precast concrete building elements that can be stacked to form a building have been suggested for certain applications. For example, U.S. Pat. No. 3,878,656 of Duwes et al. shows small specialy formed crypt elements that are stacked to form a mausoleum. Also, U.S. Pat. No. 3,894,373 of Willingham shows a variety of building elements that can be combined into a building shell. One of the Willingham elements mentioned in column 20 has fluted walls and ribs. However, these elements are difficult to electrically wire because they require the placement of conduits at planned locations for wiring or, alternately, the costly surface mounting of wiring (see col. 4, line 32 et. seq. of Willingham). In addition, these elements are difficult to finish because wall and ceiling covering materials must be secured to concrete.

SUMMARY OF THE INVENTION

The present invention is a monolithic precast concrete building module having a wall portion with a plurality of projecting ribs to which nonconcrete stud members are secured during casting of the module. By thus securing the stud members to the ribs, the module is inherently easier to use because the builder need not engage in the time consuming task of securing nailing strips to a concrete wall. Instead, wall covering materials can be secured directly to the stud members. In addition, insulating spaces between the ribs facilitate the insulation of the module.

The stud members can take different forms for different applications, but in all forms it is possible to place wiring passageways through them in a direction parallel to the wall portion without having to bore through concrete. As a result, it is extremely easy to wire a building comprised of these modules.

Another feature of the invention is a generally horizontal roof portion extending outwardly from the upper edge of the wall portion. The roof portion has rib and stud members similar to those of the wall portion.

Still another feature of the invention is a pair of roof supporting legs spaced from the wall portion and positioned at opposite sides of the roof portion.

According to another feature of the invention, sealing ridges project upwardly from the upper surface of the roof portion. The sealing ridges of adjacent modules facilitate sealing of the space between adjacent building modules.

According to still another feature of the invention, the form for casting the modules is provided with cups that receive the stud and ribs during casting.

An additional feature of the form is a rear wall forming portion mounted on a platform to which can be rolled away from the rear wall of the module after casting and a front wall forming portion which can be pivoted away from the module when the form is stripped.

A primary object of the invention is to provide an improved monolithic precast building module and an improved form for making the module.

Another object of the invention is to provide a building module which can be rapidly installed at a building site and which is easy to finish as part of a complete building.

Still another object of the invention is to provide a lightweight concrete building module which minimizes the labor required at a building site.

Still another object is to provide a building module which can be stacked cooperatively with other such modules to form buildings of diversified shapes.

A further object of the invention is to provide a building module which facilitates on site modifications of a building.

Still another object of the invention is to provide a building module which eliminates the need for special forms for window and other openings and which minimizes the need for extensive preplanning of building plumbing and wiring.

The foregoing and other objects, features and advantages of the present invention will become more apparent from the following detailed description made with reference to the accompanying drawing.

BRIEF DESCRIPTION OF DRAWING

In the drawing:

FIG. 1 is a perspective view of a building module in accordance with the present invention;

FIG. 2 is a perspective view of the underside of the module of FIG. 1;

FIG. 3 is a cross sectional view of roof portions of a pair of adjacent building modules;

FIG. 4 is a cross sectional view of a portion of the rear wall of the building module taken along lines 4—4 of FIG. 1;

FIG. 5 is a cross sectional view of an alternate form of rib and stud member;

FIG. 6 is a cross sectional view of the module taken along lines 6—6 of FIG. 1 with the stacking of the module onto another module shown by dashed lines;

FIG. 7 is a perspective view of plurality of building modules of FIG. 1;

FIG. 9 is a cross sectional view of the wall portion of the form taken along lines 9—9 of FIG. 8;

FIG. 10 is a cross sectional view of the roof portion of the form taken generally along lines 10—10 of FIG. 8;

FIG. 15 is a side elevation view of the form including a module lifting crane.

DETAILED DESCRIPTION

Figure 8:
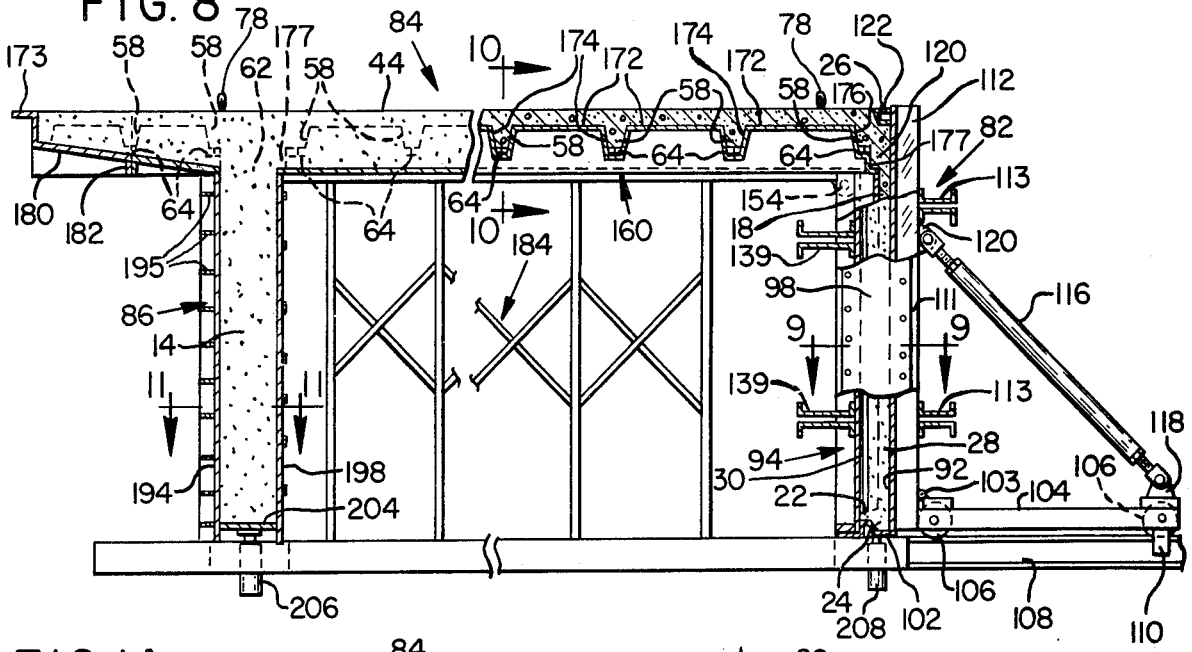
FIG. 8 is a partially broken away side elevation view of the form for casting the module of FIG. 1.

With refrence to FIGS. 1 and 2 of the drawing, a monolithic precast concrete building module includes a generally vertically wall portion 10, a horizontal roof portion 12 and a roof support means such as vertical legs 14,16. Roof portion 12 extends outwardly from the upper edge 17 of wall portion 10 while legs 14,16 are spaced from the wall portion and project downwardly from the lower surface of the roof portion.

Wall portion 10 includes a rectangular, planar wall panel 18 (shown in cross section in FIG 6) and an enlarged beam section 20 along the upper portion of the wall panel. Also, wall portion 10 includes a footing flange 22 which projects outwardly from the lower edge of wall panel 18 in the same direction as, and generally parallel to roof portion 12. Footing flange 22 provides main wall 18 with a stable supporting surface.

Wall panel 18 is preferably a thin-wall which is approximately two and one-half inches thick. Therefore, window and door openings can easily be broken through the wall panel after the module is installed. Consequently, custom forms for such openings do not have to be incorporated into the form used to cast the module. Therefore, each module can be cast from the same identical form. Furthermore, the positions of these openings can be readily changed should changes become necessary.

A plurality of parallel generally vertical ribs 28. In the preferred embodiment shown in FIG. 2, at least three of these wall ribs are provided and plural ribs are provided intermediate the marginal edges of the wall panel. These ribs extend between beam section 20 and footing flange 22 and strengthen the wall panel. These ribs extend between beam section 20 and footing flange 22 and strengthen the wall panel. As a result, the wall panel can be thinner than a wall without ribs. Also, as shown in FIG. 4, ribs 28 are tapered to facilitate stripping the form after casting.

The building module also includes a plurality of elongate vertical wall stud means or members 30 (FIG. 2) which are each secured to the free side of an associated rib, and extend between the footing flange 22 and beam 20. Said stud means are of a nonconcrete structural material, such as metal, wood or plastic, through which holes may be placed or bored. In one form, shown in FIG. 4, stud members 30 are generally T-shaped and include a web 34 which is connected at right angles to the midpoint of a head plate 32 to which wall covering materials may be attached. Web 34 has a hooked end portion 36 that is cast within the associated rib 28 to securely anchor the stud member.

A portion of web 34 projects outwardly from the free side of rib 28 so that head plate 32 is spaced from the free side. Conveniently, stud member 30 may be of twenty-five gauge sheet iron. With this construction, passageways for small diameter plumbing pipe and building wiring can be easily drilled through web 34 without having to drill through concrete. Of course, these passageways can be formed prior to casting the stud members into the module. Thus, the portion of web 34 extending between the free side of rib 28 and head plate 32 is sized to permit the placement of these passageways between the free edge of the rib and headplate. As a result, after the module is moved to a building site, plumbing and wiring can easily be installed as needed. Furthermore, changes can be made without difficulty by merely drilling new passageways through web 34. Head plates 32 are cast with their outer surfaces in a common vertical plane to facilitate attachment of wall covering materials. In addition, studs 30 are typically spaced on two foot centers so that attached wall covering material does not sag between studs.

FIG. 5 shows another form of suitable stud member 30 comprised of a wooden stud 35 and a plurality of nails 37, driven through the stud to project from one side thereof. The projecting end of the nails has a hook 39 which is cast within rib 28 to secure the stud. As shown in FIG. 5, wooden stud member 30 projects outwardly away from the free edge of rib 28 a sufficient distance to permit the placement of the electrical wiring holes therethrough.

Wall portion 10 also defines plural insulating spaces 33 such as the one shown in FIG. 4. Each insulating space is bounded at its sides by a stud member 30 and associated rib 28 and at its base by wall panel 18. These insulating spaces can be sized, by varying the size of the ribs, to provide sufficient space for a desired amount of insulation and to accommodate plumbing. These insulating spaces thus comprise channel like recesses for receiving insulation after casting.

Referring again to FIGS. 1 and 2, roof portion 12 includes a rectangular planar, generally horizontal roof panel 44. A side-beam 46 projects downwardly from one side edge of roof panel 44 and a similar side beam 48 is positioned along the other side of the roof panel. An end-beam 54 projects downwardly from the outer end 52 of roof panel 44 and extends between side-beams 46,48. A plurality of parallel spaced apart roof ribs 58 project downwardly from the lower surface of roof panel 44. These roof ribs extend between side-beams 46,48 and strengthen the roof panel so that roof panel 44 can be of thin-wall construction like wall panel 18. The roof rib nearest to wall portion 10 is formed integral with beam section 20. In addition, the ribs nearest to legs 46,48 are formed integral with a cross beam secton 62 that projects downwardly from roof panel 44 between the legs. Otherwise, the roof ribs are similar in shape to wall ribs 28. However, often deeper insulating spaces are desired in the roof portion 12 than in the wall portion 10. Therefore, the roof ribs typically project further from the roof panel than do the wall ribs from the wall panel. Consequently, more insulation can be placed in roof portion 12 than wall portion 10.

A plurality of roof stud members or joists 64 are provided which each have a portion cast into an associated roof rib 58. These roof studs are like wall studs 30 and for this reason will not be described further.

The outer end 52 of roof portion 12 projects outwardly beyond legs 14,16 in cantilever fashion. In addition, the center lines of legs 14,16 are in a vertical plane parallel to wall panel 18. Thus, when two modules are placed with their respective outer ends 52 together, a hallway is defined between the planes through the center lines of the legs of each module.

A sealing ridge 66 projects upwardly from roof panel 44 along the sides and end 52 of the module. Flange 66 is offset from the peripheral edge of the roof panel and prevents rain from flowing off the sides and end of the roof panel. Therefore, only a single gutter, positioned along the upper edge 17 of wall portion 10, is needed to carry off rain. Furthermore, when two building modules are installed adjacent to one another, as shown in FIG. 3, a flange 66 from each module is positioned along side a flange 66 of the other module. To seal the crack between the modules, a calking material 74 is placed in the crack and a cap of flashing material 76 is placed over the adjacent flanges 66.

Load lifting loops 78 are cast into the roof portion 10 at the corners of the roof portion over the wall portion 10 and also over the legs 14 for use when the module is picked up. Also, wire mesh and rebar 79, or other reinforcing material, is cast in a conventional manner within the module to add to its strength. Some of this reinforcing material is shown in FIGS. 3 and 4.

A tapered lip flange 24 projects downwardly from the lower edge of main wall 18. When two modules are stacked, lip 24 of the upper module nests within recess 26 of a lower module (shown in phantom in FIG. 6). Each of these recesses 26 is similar to the recess 26 along the upper edge 17 of wall portion 10. In addition, the lower surface of footing flange 22 and also of legs 14,16 are all in the same plane and rest upon the upper surface of roof panel 12 so that roof panel 44 of the upper module is horizontal. To provide for better stacking, the sealing ridges are eliminated from the lower module.

Another stacking arrangement of modules is shown in FIG. 7 and demonstrates the adaptability of these modules to buildings of different configurations.

With the above thin-wall construction, a relatively lightweight, but strong building module is provided. As a specific example, one form of module was approximately nine feet tall, had a roof portion area of twelve feet by twenty-six feet and weighed about 24,000 pounds.

Form for Casting the Module

The form for casting a building module in accordance with the present invention is shown in FIG. 8 and comprises a wall form 82, a roof form 84 and a leg form 86.

Wall form 82, FIGS. 8 and 9, includes a flat rectangular rear wall plate 92 which abuts the rear wall of the module during casting and a rib forming plate 94. Wall form 82 also includes a pair of rectangular upright side plates 98,100 that secure plates 92,94 together during casting and a base plate 102 for closing the space between plates 92,94 at the bottom of the wall form.

The rear wall plate 92 is mounted on a platform 104 carried by wheels 106 for rolling along a track 108 toward and away from the building module. A clamp 110 locks platform 104 to track 108 to brace plate 92 in position against the rear of the building module. A flange 111 projects rearwardly from the peripheral edges of plate 92 and provides a surface to which side plates 98,100 are bolted. A plurality of vertical box beams 112 and horizontal beams 113 reinforce plate 92.

In addition, a pair of rods 116, one being shown in FIG. 8, are each pivoted at one end to a flange 118 spaced from plate 92 on platform 104 and at the other end to a flange 120 mounted to an upper portion of a box beam 112. Rotation of the central portion of rod 116 about its axis adjusts the length of the rod in turnbuckle like fashion. This in turn causes plate 92 to pivot about the axis of a hinge 103 which secures the plate to the platform to thereby adjust the plate until it is vertical. A recess forming member 122 is attached to the upper edge of plate 92 to form the recess 26 along the upper edge 17 of wall portion 10.

Rib forming plate 94 includes a plurality of rectangular panel surface forming sections 126 that abut wall panel 18 during casting. A rib and stud receiving cup 128 joins sections126 together. Similar cups 130 are bounded at one side by the respective side plate 98,100 so that the side of wall portion 10 is perpendicular to wall panel 18. Each cup 128 includes a first rib side plate 132 projecting outwardly form the edge of one panel surface forming section 126 and a second rib side plate 134 projecting outwardly from the edge of an adjacent section 126. The space between plates 132 and 134 narrows moving away from sections 126 until plates 132,134 are spaced apart a distance approximately equal to the width of plate 32 of stud 30. A U-shaped channel beam 136 has its legs connected to the free ends of plates 132, 134 to tie them together.

Prior to casting, wall covering flange 32 of each stud member 30 is placed in contact with the base of a channel member 136. In addition, rectangular styrofoam strip 138 is placed along each side of flange portion 34 and in contact with plate 32. Strips 138 fit snuggly within the channel member 136 to prevent concrete from entering the channel during casting. Thus, when strips 138 are removed following casting, plate 132 is spaced from the outer end of rib 28.

Figure 12:
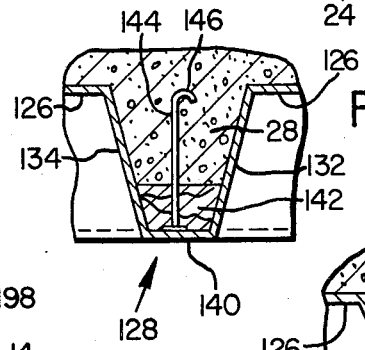
FIG. 12 is a cross sectional view of an alternate rib and stud receiving cup portion of the form.
Figure 13:
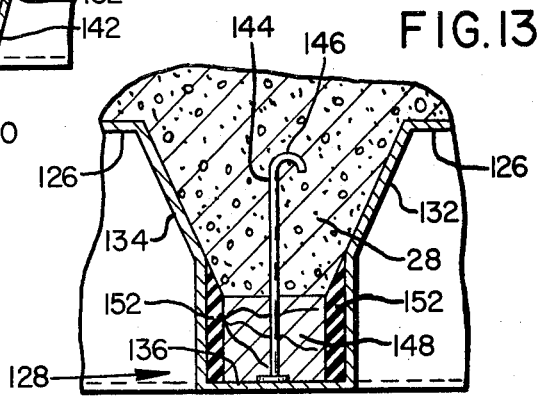
FIG. 13 is a cross sectional view of another embodiment of cup portion.

Alternate forms of cups 128 are shown in FIGS. 12 and 13. In the FIG. 12 form, plates 132,134 are joined together by a cup end plate 140 instead of by a channel member 136. Also, a trapezoidal shaped wooden stud member 142 is placed with its smallest parallel side in abutment with end plate 140. Stud 142 fits tightly between plates 134,132 and against plate 140 so that concrete from rib 28 does not pass between the stud and contacting cup. A plurality of nails 144 driven through the stud 142 each have a hooked portion 146 that extends between plates 132,134 so that the nail is cast within the rib 28. The cup of FIG. 13 is like those of FIG. 9 except that a gasket 152 is connected to each leg of the channel member 136. Prior to casting, a rectangular wooden stud 148 is positioned between the gaskets. The gaskets prevent concrete from passing between the stud and channel member and also facilitate stripping of the form following casting. A pivot pin 154 secures the upper end of rib forming plate 94 to a lower portion of roof form 84. Therefore, plate 94 can be pivoted about pin 154 to strip it from the casting.

Also, horizontal reinforcing beams 139 are secured to the back of rib forming plate 94.

In addition, base plate 102 of the wall form portion has a step 150 at approximately its mid-point to define the lower surface of footing flange 22 as well as lip 24 of the wall portion 10.

Roof form portion 84 includes a beam defining section 158 (FIG. 10) positioned along one side of the roof form for casting the concrete beam 48. A similar beam defining section 160 is positioned along the other side of the module for casting beam 46. Each beam forming section is generally U-shaped with an inner leg 164, a base 166 and an outer leg 168 which is longer than leg 164 to prevent concrete from flowing off the sides of the foam. Inner legs 164 are connected together by a generally rectangular roof forming plate having a plurality of rectangular roof panel defining sections 172. Sections 172 are joined together at their edges by roof rib and stud or joist receiving cup members 174. The roof cups 174 are similar to wall cups 128 and hence will not be described further.

A somewhat different form of cup member 176 is connected to the section 172 nearest to the wall portion. Unlike cups 128, rib side plate 132 and the connecting leg of the channel 136 are eliminated. Instead, one leg of a piece of angle beam 177 projects downwardly from the edge of the base of the channel of cup 176 nearest the wall. The other leg of the angle beam abuts the upper edge of rib forming plate 94 during casting. Consequently, cup 176 and angle beam 177 form the enlarged concrete beam section 20 integral with the adjacent rib 58. A similar cup 176 and angle beam 177 at the wall side of legs 14, 16 forms cross beam 62 integrally with the adjacent rib 58. Also, a cup 176 forms rib 58 at the other side of beam 62.

An end forming section 180 is bolted to a flange 182 at the outer end of beam forming sections 158,160. The beam forming sections 158,160 and corresponding sections of end plate 180 taper upwardly from legs 14,16 to the outer end of the module to increase the vertical clearance at the outer end.

With reference to FIG. 10, a sealing ridge forming assembly 167 is positioned along the sides and outer end of the form of casting ridges 66. Each assembly includes a beam 170 connected to a flange 173 projecting outwardly from the upper edges of plates 168 at the sides of the form and from the upper edge of plate 54 at the outer end of the form. Beam 170 turns vertically upwardly at a position offset inwardly from the edge of wall panel 44 and then extends horizontally to a box beam 169 which in turn projects downwardly to the plane containing flange 173. Webs 171 reinforce the sealing assemblies. During casting, concrete is forced into the resulting space between box beam 169 and the vertical portion of beam 170 to form the sealing ridges 66. A suitable roof bracing framework, a portion being shown as 184, supports the roof form.

Figure 14:
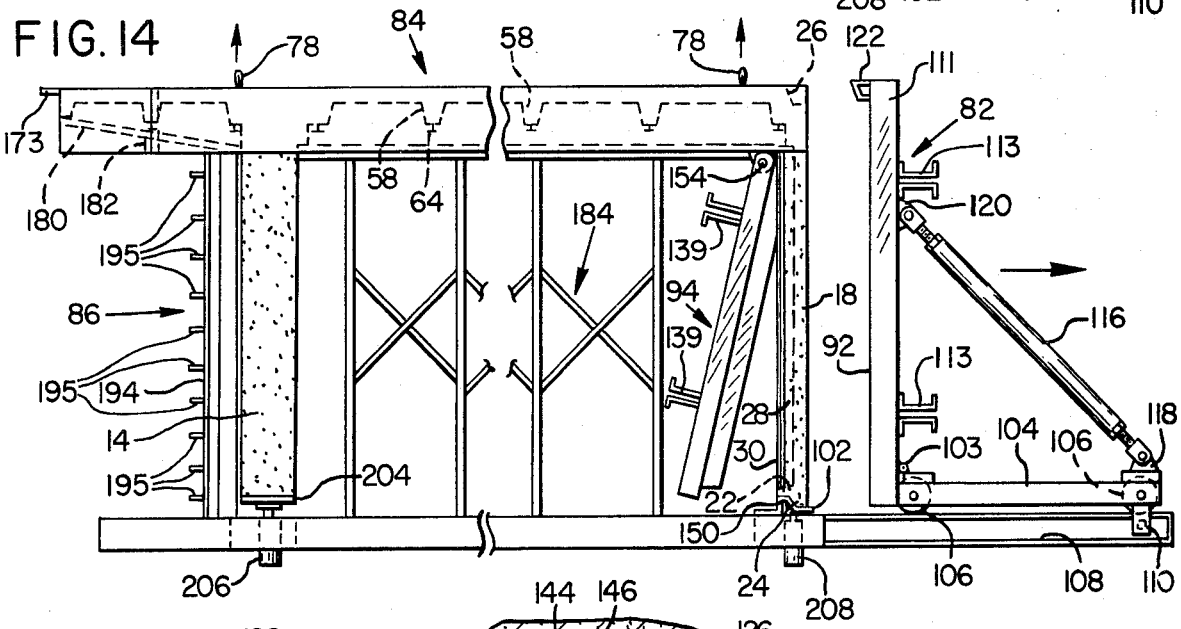
FIG. 14 is a side elevation view of the form of FIG. 8.
Figure 11:
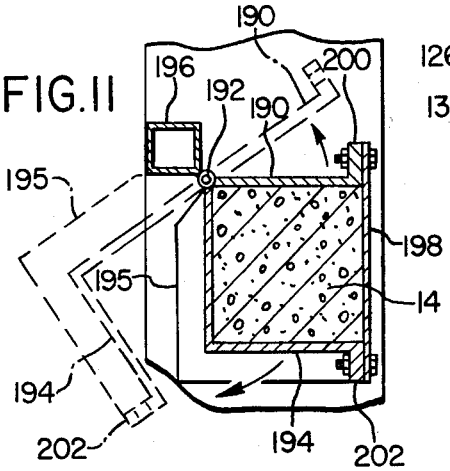
FIG. 11 is a cross sectional view of a leg portion of the form taken along lines 11—11 of FIG. 8.

As shown in FIGS. 8 and 14, leg forms 86 abut the lower edge of roof form 84. Each leg form includes a leg side plate 190 pivoted by a hinge 192 (FIG. 11) to an L-shaped member 194 which is reinforced by a plurality of flanges 195. Hinge 192 is mounted to a box beam section 196 of the framework. Prior to casting, plate 190 is pivoted until it is at right angles to member 194. A capping plate 198 is bolted to flanges 200,202 of the respective plate 190 and member 194 to provide a leg form of square cross section. The bottom of each leg form is closed by a leg base 204.

A hydraulic jack 206 is provided under each leg (FIG. 14) and a pair of similar jacks 208 are placed under wall portion 10. These jacks break the casting free from the roof form portion after curing. The entire form is preferably made of rigid steel plate and beams for strength.

Casting of the Module

Prior to casting the building module, stud members 30,64 and the strips of styrofoam 138 are placed within cups 128,130,174 and 176. In addition, the reinforcing mesh and rods are positioned. The form is assembled by pivoting wall rib defining plate 94 into a vertical position and rolling face plate 92 into position so that side plates 98,100 can secure plates 92 and 94 together. In addition, leg plates 190 and 194 are pivoted so that leg capping plates 198 can be attached. Also, end section 180 is secured. Furthermore, if the particular module will be an upper module of a building, then the sealing ridge forming assemblies 167 are attached. Concrete is then poured into the form and entrapped air is removed by conventional vibratory devices (not shown). After the concrete has adequately cured, the form is stripped by reversing the assembly steps.

Thereafter, a crane 212 (FIG. 15) mounted by wheels 214 on a track is moved into position above the module. Electric hoists 218 on the crane are then each connected to one of the load lifting loops 78 and jacks 206,208 are activated to break the casting loose from the roof form. Thereafter, hoists 218 raise the module until it clears the form so that crane 212 can transport it away from the form.

Having illustrated and described the principles of the invention with reference to what are presently several preferred embodiments, it should be apparent to those skilled in the art that the invention may be modified in arrangement and detail without departing from such principles. I claim as my invention all such modifications as come within the true spirit and scope of the following claims.

I claim:

1. A building module comprising:

a precast monolithic concrete building element including an upright wall means, roof means projecting outwardly in a first direction from the upper end of said wall means and roof support means spaced from said wall means;

said wall means including a wall panel, said wall means also including plural spaced apart generally parallel upright wall ribs projecting outwardly in said first direction from one surface of said wall panel and defining channel like recesses therebetween bounded by exposed concrete surfaces of said ribs and one surface;

said roof means including a roof panel having an inner end at the upper edge of said wall means and an outer end spaced from said wall means, said roof means also including plural spaced apart generally parallel roof ribs projecting outwardly in a second direction from a lower surface of said roof panel and defining channel like recesses therebetween bounded by exposed concrete surfaces of said roof ribs and lower surface of said roof panel;

a plurality of wall stud means of a nonconcrete structural material for supporting wall covering materials, each said wall stud means including an anchoring portion cast into the free side of an associated wall rib and a projecting portion which projects outwardly away from such free side a sufficient distance to permit the placement of electrical wiring openings through which projecting portion; and a plurality of roof stud means of a nonconcrete structural material for supporting roof covering materials, each said roof stud means including an anchoring portion cast into the free side of an associated roof rib and a projecting portion which projects outwardly away from such free side a sufficient distance to permit the placement of electrical wiring openings through such projecting portion.

2. A building module according to claim 1 in which said wall panel is of thin-wall construction to facilitate the placement of openings through the wall panel in the spaces between the wall ribs.

3. A building module according to claim 1 in which said wall stud means and said roof stud means are of metal and each includes a head plate for supporting wall and roof covering materials and a web connected at one end to said head plate, said anchoring portion comprising a portion of the other end of said web, said web defining the electrical wiring openings therethrough and between the head and anchoring portion.

4. A building module according to claim 1 in which said stud means each comprise wooden studs and a plurality of nails projecting from one side of said studs, said anchoring portion comprising the projecting portions of said nails.

5. A building module comprising:

a precast concrete building element including a vertical wall, a horizontal roof projecting outwardly in one direction from the upper edge of said wall, and a pair of vertical legs spaced from said wall, one of said legs projecting downwardly from the lower surface of the roof at one side edge of the roof, the other of said legs projecting downwardly from the lower surface of the roof at the other side edge of the roof, the center lines of said legs being in a vertical plane parallel to the wall, the outer end of said roof being cantilevered outwardly beyond said legs;

said wall comprising a wall panel, an upper horizontal wall beam section projecting in said one direction from said wall panel and extending along the upper marginal edge portion from side to side of said wall, a lower horizontal wall beam section projecting in said one direction from said wall panel and extending along the lower marginal edge portion from side to side of said wall panel, and at least three spaced apart wall ribs extending vertically from said upper wall beam section to said lower wall beam section so as to define channel like recesses therebetween adapted to receive insulation therein after casting;

said roof comprising a roof panel, a roof beam side section projecting downwardly along each side of said roof panel, said roof beam side sections tapering upwardly from said legs to the outer end of the roof to increase the vertical clearance between the outer end of the roof and the surface below, an enlarged horizontal cross beam section projecting downwardly from the lower surface of said roof panel and extending between said legs, at least three generally parallel spaced apart horizontal roof ribs extending between said roof side beam sections so as to define channel like recesses therebetween adapted to receive insulation therein after casting said roof ribs being sized so as to project downwardly from the lower surface of said roof panel a greater distance than said wall ribs project from said wall panel so that the channel like recesses defined between said roof ribs have a greater depth than the channel like recesses defined between said wall ribs;

a plurality of wall studs of a nonconcrete structural material for supporting wall covering materials, each said wall stud including an anchoring portion cast into the free side of an associated wall rib and a projecting portion which projects outwardly away from such free side a sufficient distance to permit the placement of electrical wiring openings through such projecting portion, each adjacent pair of said roof studs defining a free space therebetween through which electrical wiring may pass between said wall studs; and a plurality of roof studs of a nonconcrete structural material for supporting roof covering materials, each said roof stud including an anchoring portion cast into the free side of an associated roof rib and a projecting portion which projects outwardly away from such free side a sufficient distance to permit the placement of electrical wiring openings through such projecting portion, each adjacent pair of said roof studs defining a free space therebetween through which electrical wiring may pass between said roof studs.

6. A building module according to claim 5 in which said roof also includes sealing ridges projecting upwardly from the upper surface of said roof panel, said sealing ridges being positioned along the sides and outer end of said roof panel for preventing rain water from flowing past the ridges and off said roof panel and so that a cap can be placed over the adjacent ridges of two abutting modules to seal the space between them.

7. A building module according to claim 6 which includes a lip projecting downwardly from the bottom of said wall panel with one side surface of said lip positioned in a vertical plane containing the surface of said wall panel opposite the surface from which said wall ribs project, and a notch along the upper edge of the wall panel defined at its base by a portion of said wall panel, open at the top, defined at one side by a portion of said roof panel and open opposite said one side, the lip of one module nesting within the notch of another module to facilitate stacking of two modules.

* * * * *